United States Patent [19]

Miller et al.

[11] 4,094,404

[45] June 13, 1978

[54] COMBINED DISPLAY AND SHIPPING PACKAGE

[75] Inventors: Paul D. Miller, New York; V. Lorenzo Porcelli, Ossining, both of N.Y.

[73] Assignee: GAF Corporation, New York, N.Y.

[21] Appl. No.: 777,118

[22] Filed: Mar. 14, 1977

[51] Int. Cl.[2] ..... B65D 5/50; B65D 5/52

[52] U.S. Cl. ..... 206/45.15; 229/19; 248/455

[58] Field of Search ..... 206/45.11, 45.15, 45.18, 206/45.14; 229/9, 11, 19, 20; 248/455, 459

[56] References Cited

U.S. PATENT DOCUMENTS

| | | | |
|---|---|---|---|
| 716,139 | 12/1902 | Sturtevant | 229/9 |
| 1,875,781 | 9/1932 | Turner | 206/44.12 |
| 2,115,538 | 4/1938 | Rachin et al. | 206/44 |
| 2,142,883 | 1/1939 | Chaney et al. | 206/44 |
| 2,503,379 | 4/1950 | Davis | 229/20 |
| 2,796,978 | 6/1957 | Struble | 206/44 |
| 3,189,170 | 6/1965 | Elliott, Jr. | 206/44 |
| 3,362,448 | 1/1968 | Everburg | 206/45 |
| 3,371,772 | 3/1968 | Fontannaz | 206/45.19 |
| 3,467,245 | 9/1969 | Kowanada | 206/44 |
| 3,595,382 | 7/1971 | Hofer | 206/45.19 |
| 3,648,918 | 3/1972 | Van Inwagen | 229/9 |
| 3,823,864 | 7/1974 | Ohkubo | 229/9 |

FOREIGN PATENT DOCUMENTS

| | | | |
|---|---|---|---|
| 745,852 | 5/1933 | France | 229/9 |
| 1,100,268 | 9/1955 | France | 229/9 |
| 16,632 | 7/1956 | Germany | 206/45.15 |
| 1,275,040 | 8/1968 | Germany | 229/19 |
| 884,100 | 12/1961 | United Kingdom | 206/45.15 |

*Primary Examiner*—William Price
*Assistant Examiner*—Bruce H. Bernstein
*Attorney, Agent, or Firm*—Walter C. Kehm; J. Gary Mohr

[57] ABSTRACT

The invention is directed to a combined display and shipping package which has two major components, an outer sleeve and an inner shell arranged for telescoping engagement with one another. The outer sleeve covers and provides protection for the inner shell during shipment and is slid back over the inner shell in a telescoping manner to permit visual display of an item to be displayed without the full removal of the protective outer sleeve which may or may not have advertising or display information on it. The inner shell has an inclined base so that when the package is used for display purposes, it maintains an inclined position to project the display item into full view of a prospective customer. To prevent the display package from tipping, the item displayed therein is secured in the package in a manner so that the combined centers of gravity for the item displayed and the display package is located to prevent tipping of the package without the need of additional support.

2 Claims, 6 Drawing Figures

COMBINED DISPLAY AND SHIPPING PACKAGE

BACKGROUND OF THE INVENTION

Combination shipping and display cartons are not new in the packaging art as indicated by U.S. Pat. No. 3,823,864 to Hachiro Ohkubo which discloses an outer rectangular shell enclosing an inner display package. The outer shell of this prior patent completely covers the inner shell during shipping and is removed or parially removed during display.

Both U.S. Pats. 3,467,245 and 3,362,448 to Akiko Kawanada and Donald E. Everburg respectively disclose shipping cartons that may also be used as display cartons. None of the prior devices, however, provide for a display case that maintains an inclined position to its display surface in order to make the displayed item more outstanding to a potential customer, as is provided by the present invention.

While display packages that do maintain an inclined position with the surface upon which they are beind displayed, and could be used as both shipping and display packages, are known they all require additional support members to support the packages in an inclined display position.

Packages which are used to display items at an incline are also known, however, these usually have flat surfaces mating with the counter on which they are displayed. Therefore, in order to arrange the package at an incline to the counter surface, an additional insert within the display carton is required which is inclined to the base of the carton in order to provide necessary support.

A primary object, therefore, of the present invention is to provide a display package which may be used both for shipping and display and which has a base surface inclined to the longitudinal axis of the package so that when the package is supported by its base on a surface for display, the longitudinal axis of the package will be inclined at an angle to the display surface so that the item may be more attractively displayed.

Another object is to provide a display and shipping package which is simple to manufacture, use and assemble, yet is attractive, and affords the necessary protection required of a shipping package.

SUMMARY OF THE INVENTION

The present invention represents a new structure for a combined shipping and display package that is simple to manufacture, easy to use, attractive, yet sturdy enough to use as a shipping carton. The package basically comprises an outer sleeve and an inner shell which is in slidable contact with the outer sleeve. The outer sleeve is a rectangularly shaped housing with two of its parallel end surfaces being open. The inner shell is rectangularly shaped having a front, a back, side surfaces and two end surfaces, one of which is inclined to the front and back surfaces. The inner shell carries a display tray shaped to accommodate the item that is to be displayed or shipped. The tray is inserted within the inner shell having an open surface thereof flush with the surface of the shell. During shipping or storage, the item to be displayed or stored is placed within the display tray in such a fashion that no part of the display item extends beyond the surface of the tray so that the sleeve can readily close over the entire package. When the item is to be displayed it will be repositioned to protrude from the tray. The outer sleeve is closed over the inner shell when used for shipping or storage and is slid to an open position to expose the item during display.

DETAILED DESCRIPTION OF THE INVENTION

Figure 1:
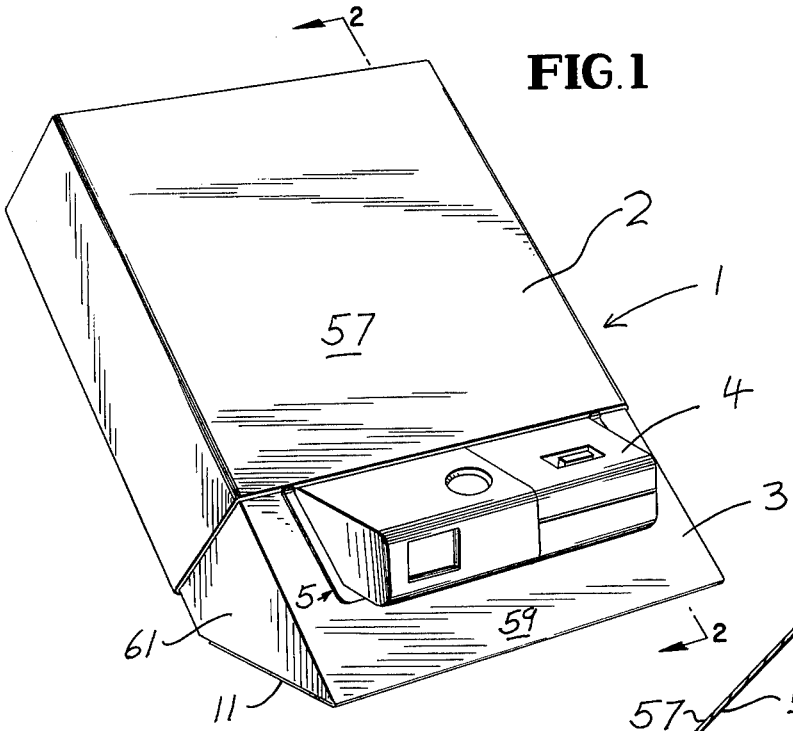
FIG. 1 is a perspective view of the present invention showing the outer sleeve, inner shell telescopingly extended therefrom, and a displayed item in the display position.

Referring now to the drawings wherein like numerals have been used throughout the various views to designate like components, the present invention is shown and described as embodied in a pocket camera shipping and display package. However, it will be understood by those skilled in the art that the invention is not to be limited for use with such a camera, and may be utilized with other items for shipping and display.

Figure 2:
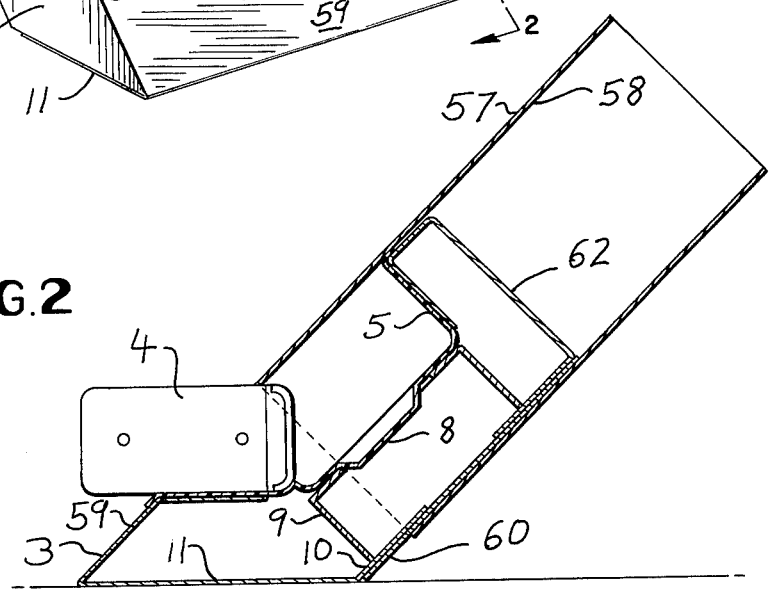
FIG. 2 is a sectional view taken along lines II—II of FIG. 1.
Figure 3:
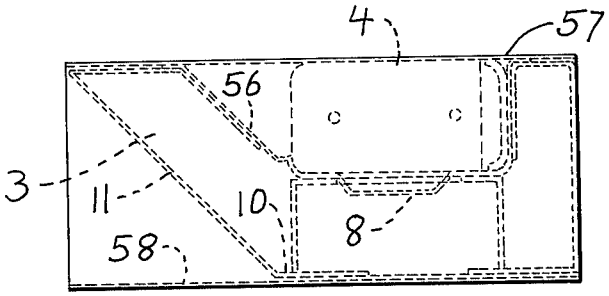
FIG. 3 is a side elevational view of the invention showing the outer sleeve, inner shell, and the item to be displayed, in a position for shipping.
Figure 6:
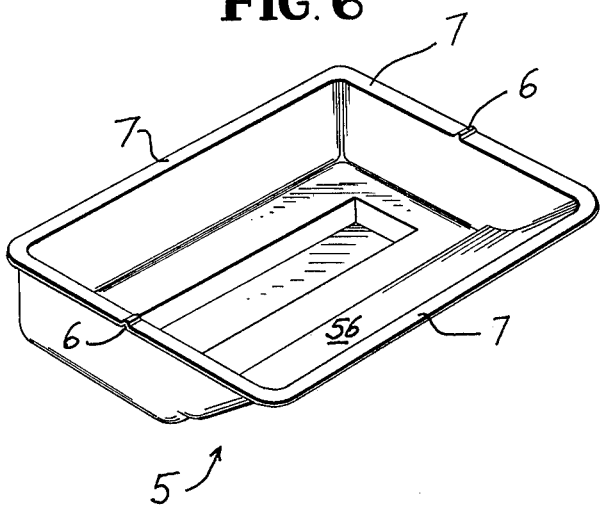
FIG. 6 is a perspective view of the display tray.

Referring now in more detail to the accompanying drawings, FIG. 1 shows a pocket camera shipping and display package generally indicated as 1. The package 1 has an outer sleeve 2 and an inner shell 3. The outer sleeve 2 has an outer surface 57 and an inner surface 58. The inner shell 3 has a front surface 59, a back surface 60, side surfaces 61, and end surfaces 62 and 11. The package 1 is shown in FIGS. 1 and 2 in a display position with the sleeve 2 telescopingly extended so that a pocket camera 4, may be displayed. Pocket camera 4 is securely held in display package 1 by a display tray 5 more clearly shown in FIG. 6. Display tray 5 has the general shape of the item to be displayed. When the item is not being displayed, it is completely within the tray 5 with no portion of it extending above top surface 7 of display tray 5 as shown in FIG. 3. In other words, if the package is used for shipping, the item will lie in the tray 5 in a first position, and will lie in the tray 5 in a second position for display.

Display tray 5 has two protrusions 6 that extend above the top surface 7 of said tray 5. The protrusions 6 act as a detent in order to resist sliding between the interior surface 58 of the outer sleeve 2 and the front surface 59 of the inner shell 3 which are in slidable contact.

FIG. 3 shows the package 1 in its shipping position where outer sleeve 2 is completely slid over the inner shell 3. Display tray 5 has a mounting surface 8 which may be secured to the inner shell surface 10 of the inner shell 3 either directly or through a mounting device 9 which acts as a spacer between mounting surface 8 and the inner shell surface 10, to secure the display tray 5 within the inner shell 3. Inner shell 3 is generally of a rectangular shape with end surface 11 inclined to the front and rear surfaces. The inclined end surface 11 acts as a support base of the package 1 when the package is being used for display purposes. In order to prevent the inclined package 1 from tipping when used for display purposes, as shown in FIG. 2, the display item 4 must be placed within the display tray 5 in a manner so that the combined centers of gravity of the package 1 and the display item 4 is located in a position to overcome the forces exerted by the center of gravity of the package 1 which when standing without the display item would tip over. Correct positioning of the display item 4 is assured by a stop shelf 56 within the display tray 5 which prevents the display item from being placed incorrectly within the display tray 5.

Figure 4:
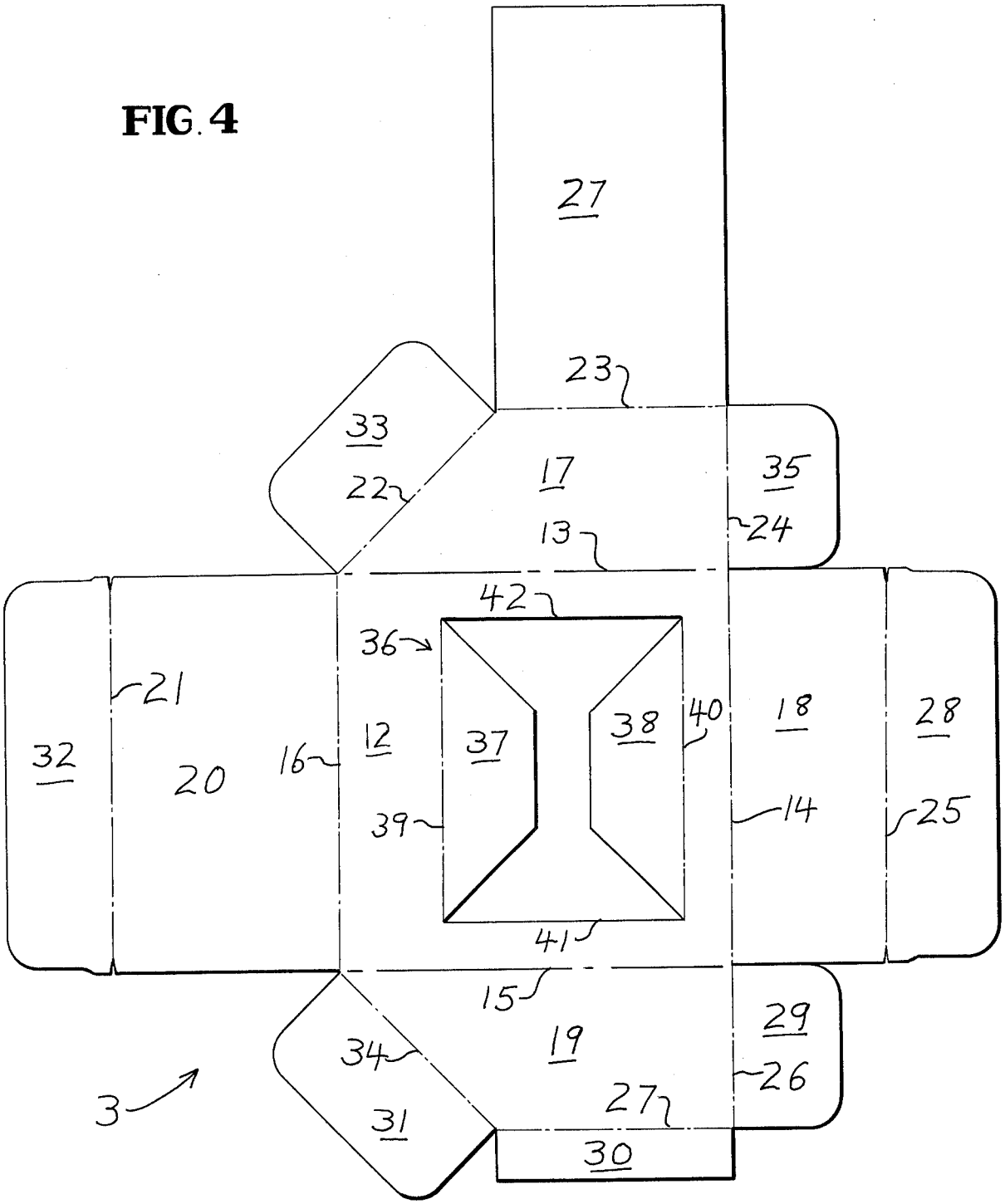
FIG. 4 is an expansion view of the inner shell prior to being assembled.

Referring to FIG. 4, the inner shell 3 is assembled with a top portion 12 of the inner shell 3 having around its outer edges score lines 13, 14, 15 and 16. These score lines act as pivotal points for flaps 17, 18, 19 and 20 respectively. Flaps 17, 18 and 19 are each folded so as to be perpendicular with the top portion 12 and extend in the same direction. Score lines 21, 22, 23, 24, 25, 26, 27 and 34 are pivotal edges for flaps 32, 33, 27, 35, 28, 29, 30 and 31 respectively. Flap 32 is folded at an angle of greater than 90° with respect to flap 20. Flaps 33, 27 and 35 are all folded at an angle of 90° with flap 18. Flaps 29, 30 and 31 are all folded at an angle of 90° with flap 19. Subsequent to the above folding, flap 27 is secured to flap 30 so that flap 27 makes an angle of 90° with flap 19. Flap 32 is in interlocking contact with flaps 27 and 30 as a result of the folded position of flaps 31 and 32. Flap 28 is also in interlocking contact with flaps 27 and 30 as a result of the folded position of flaps 35 and 29. A well 36 is formed within inner shell 3 by having flaps 37 and 38 freely pivotal along score lines 39 and 40 respectively. The shape of the well 36, as shown by lines 39, 40, 41 and 42 is determined by the outer dimensions of the display tray 5. Although the inner shell 3 appears complicated when completed it can be made from a single sheet of material by a single stamping with a die blade, and can be assembled three dimensionally by folding the resulting score lines, thereby making it suitable for mass production at low cost.

Figure 5:
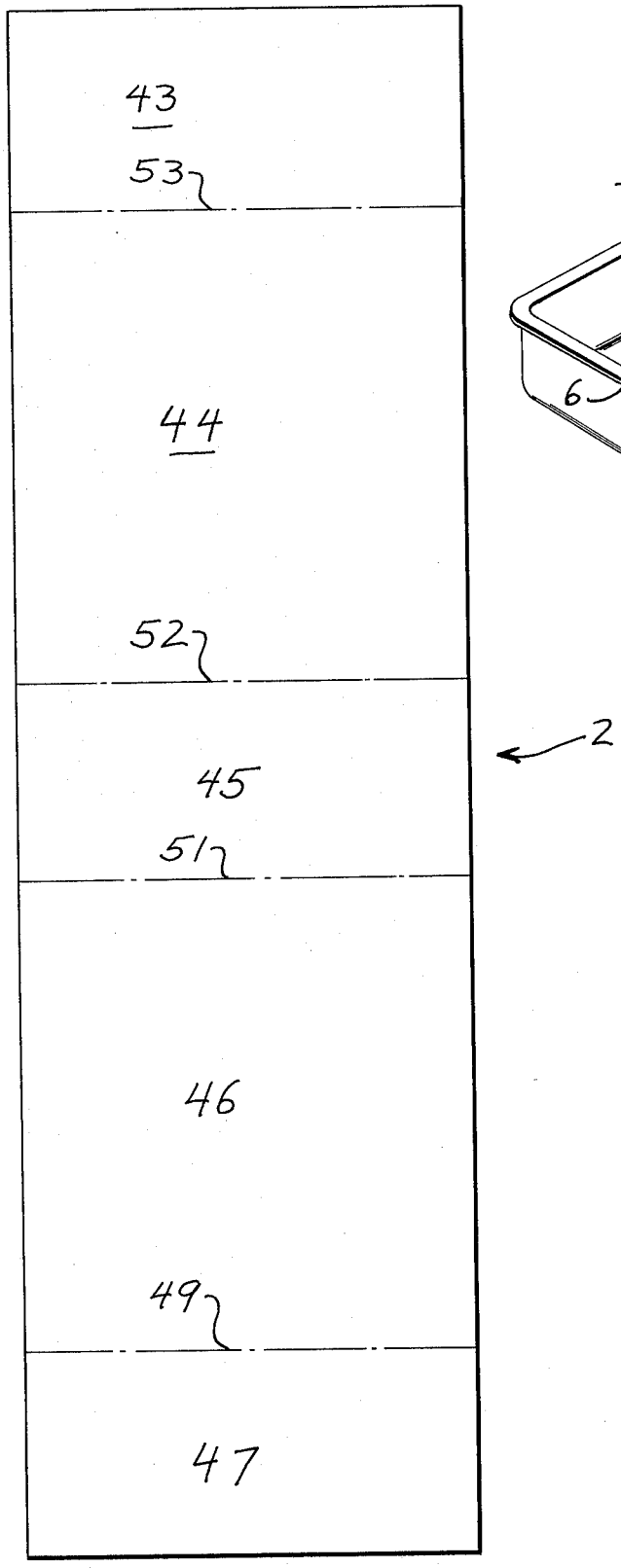
FIG. 5 is an expansion view of the outer sleeve prior to being assembled.

Referring now to FIG. 5 the outer sleeve 2 is assembled by flap 43 being folded along score line 53 at an angle of 90° with flap 44. Flap 45 is folded along score lines 52 and 51 at an angle of 90° with both flaps 44 and 46. Flap 47 is folded along score line 49 at an angle of 90° with flap 46 thereby causing contact of flap 47 with flap 43 to which it is securely fastened to form the outer sleeve 2.

When package 1 is in its shipping position outer sleeve 2 completely covers inner shell 3 and display item 4 is totally within display tray 5 without any protrusions above top surface 7 of display tray 5, to provide a secure shipping package. When package 1 is in its display position outer sleeve 2 only partially covers inner shell 3 and display item 4 is repositioned in the tray 5 to protrude from display tray 5 past its top surface 7. Since base 11 is inclined to the longitudinal axis of the package, it places display item 5 in clear view of prospective customers. The critical positioning of the display item 4 within the display tray 5 is assured by step shelf 56. Step shelf 56 assures a proper combined center of gravity of the display item 4 and the package 1 to eliminate the need of any support structure for preventing package 1 and its display item 4 from tipping.

The present invention thereby provides for a display and shipping package that is self-supporting with a minimum of rearrangement required to transfer the shipping package to the display package or vice versa. Also, advertising or other information placed upon the outer shipping sleeve will not be lost or covered during display use of the package.

What is claimed is:

1. An improved shipping and display package comprising an outer sleeve, and an inner shell, said outer sleeve having an outer and inner surface, said inner shell having a front, back, side and end surfaces with at least one end surface inclined to the front surface of said inner shell, a display tray within and secured to said inner shell, an upper surface of said display tray lying in the same plane as the front surface of the inner shell, a well located on the front surface of said inner shell for supporting said display tray within the inner shell, said display tray being constructed to accommodate a display item in one of two alternate positions, a first position in which the display item is totally enclosed within said tray with no portion of said item extending above the top surface of said tray and a second position in which the displayed item protrudes above the top surface of said display tray, when the display item is in said second position said outer sleeve is in a position above said display item, thereby enlarging the surface area of the display package in a telescoping manner, the combined centers of gravity of the displayed item and the display package being located in a position that prevents the display package from tipping when said package is resting on said inclined end surface.

2. The shipping and display package according to claim 1 wherein said upper surface has at least two protrusions extending outside the plane of said surface which make contact with the inner surface of the outer sleeve to restrict sliding between the inner shell and outer sleeve when the outer sleeve is completely covering said inner shell.

* * * * *